United States Patent [19]

Taylor et al.

[11] Patent Number: 4,703,744

[45] Date of Patent: Nov. 3, 1987

[54] APPARATUS FOR SHOOTING A PROJECTILE

[75] Inventors: Stewart A. Taylor, 320 Cherokee St., Kingsport, Tenn. 37662; James C. Gullette, Greer, S.C.

[73] Assignee: Stewart A. Taylor, Kingsport, Tenn.

[21] Appl. No.: 878,723

[22] Filed: Oct. 2, 1986

[51] Int. Cl.[4] ..... F41B 7/00

[52] U.S. Cl. ..... 124/20 R; 273/419

[58] Field of Search ..... 124/17, 20 R, 22; 273/416

[56] References Cited

U.S. PATENT DOCUMENTS

| | | | |
|---|---|---|---|
| D. 158,906 | 6/1950 | Stalker | D22/3 |
| 369,314 | 9/1887 | Brouger . | |
| 1,037,648 | 9/1912 | Marzak . | |
| 1,611,886 | 12/1926 | Chaplin . | |
| 2,484,589 | 10/1949 | Richards | 273/416 |
| 3,312,989 | 4/1967 | Palolantonio | 7/11 |
| 3,415,239 | 12/1968 | Swett | 273/416 |
| 4,411,248 | 10/1983 | Kiverson | 124/20 R |
| 4,458,658 | 7/1984 | Blair | 124/20 R |

*Primary Examiner*—Richard C. Pinkham
*Assistant Examiner*—J. Brown
*Attorney, Agent, or Firm*—Reed Smith Shaw & McClay

[57] ABSTRACT

The invention relates to an accessory for firing small arrows which can be releasably attached to a knife handle. The accessory includes two spaced channel members each having a number of pulleys fixed for rotation within each channel. An elastic cord is sheaved about the pulleys and extends between the channel members. An arrow is configured to engage the cord and permit drawing the arrow into a firing position from which the arrow can be fired.

13 Claims, 6 Drawing Figures

APPARATUS FOR SHOOTING A PROJECTILE

BACKGROUND AND DISCUSSION OF THE INVENTION

Knives recently have been adapted to perform a number of functions other than the cutting and slicing for which it was originally designed. More recently, knives known as survival instruments have included the facilities to contain fishing elements, compass, matches, bottle openers, scalers, just to name a few. However, very few, if any, of these knives have the provision to take small game and fish. Rather, the alternative has been to form the knife into a spear and capture the game or fish by spearing them. This approach suffers from obvious deficiencies such as accuracy, speed, distance and potential loss of the knife.

The invention described herein overcomes many of the deficiencies in certain uses of a knife as discussed above. The invention relates to an accessory which can be attached to the knife for delivering a projectile at sufficient speed and force for capturing game and fish. The projectile used in the particular embodiment is an arrow which, when used with the accessory, has a penetration and accuracy at 15–20 yards. The accessory is compact in design and adaptable for confining situations. As a result, it can easily be brought into firing position from a tree or the inside of a small tent. Because of its size and design, the arrows used are relatively small and can be stored as a result conveniently in large numbers. Furthermore, the arrows can be formed readily from branches or other materials available in the wilderness.

The accessory of the invention is adapted to any hollow handle survival knife and becomes and extension of the knife itself. The advantage of this approach is that the knife always remains in the users hand avoiding the possibility of loss of the knife which could occur if the knife were used as a spear. In addition, because it is used on the handle of the knife, the accessory can be used in a tree without a treestand. The potential for obtaining fish is far superior to that of a spear. Because of the arrowhead configuration, once the arrow is lodged in the fish, often the fish will not be able to get away as easily as it could with a spear formed from the knife itself.

The device can also serve as a trap. By pushing the knife blade into the ground or wedging it into a tree, the accessory can be set over a game trail and activated by remote release or a trip wire. It also has the potential in the same manner to activate a game snare.

The above has been a brief discussion of certain advantages of the invention described herein. Other advantages will become more apparent from the detailed discussion of the preferred embodiment which follows.

DETAILED DESCRIPTION OF THE PREFERRED EMBODIMENT

Figure 1:
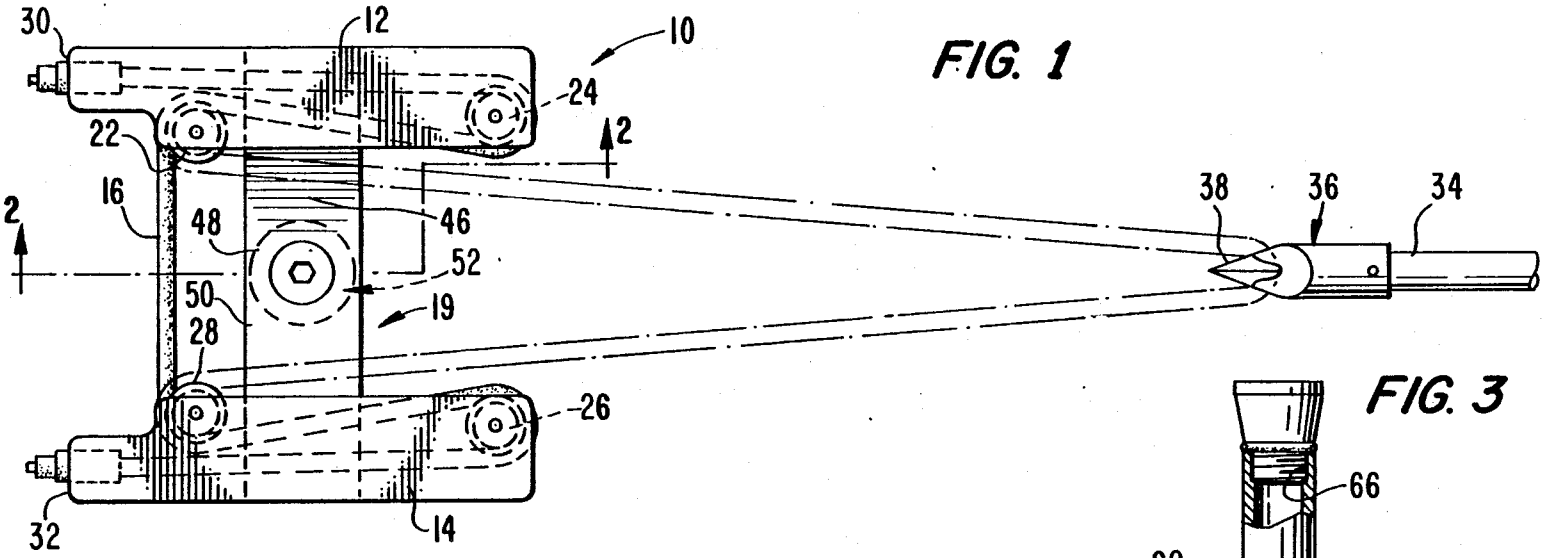
FIG. 1 is a plan view of the accessory with the cord in a firing position shown in phantom lines.
Figure 3:
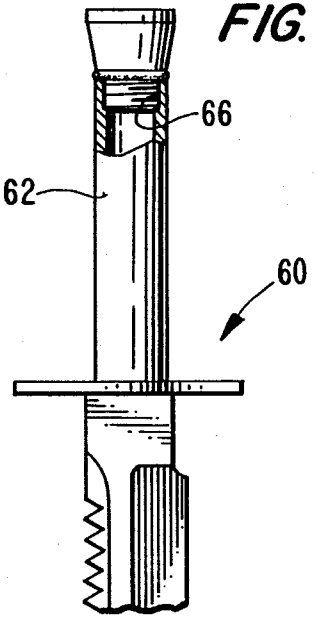
FIG. 3 is an elevation of a knife to which the accessory of FIG. 2 can be attached.
Figure 2:
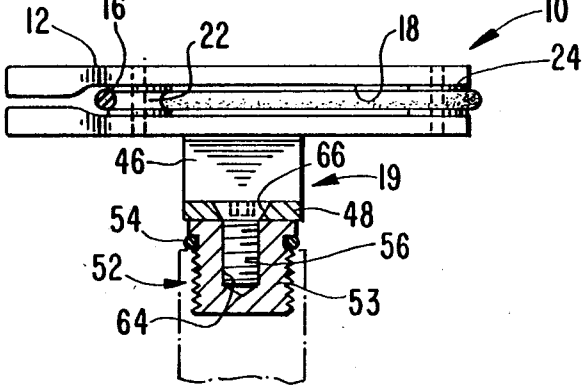
FIG. 2 is an elevation of the device as shown in FIG. 1.
Figure 4:
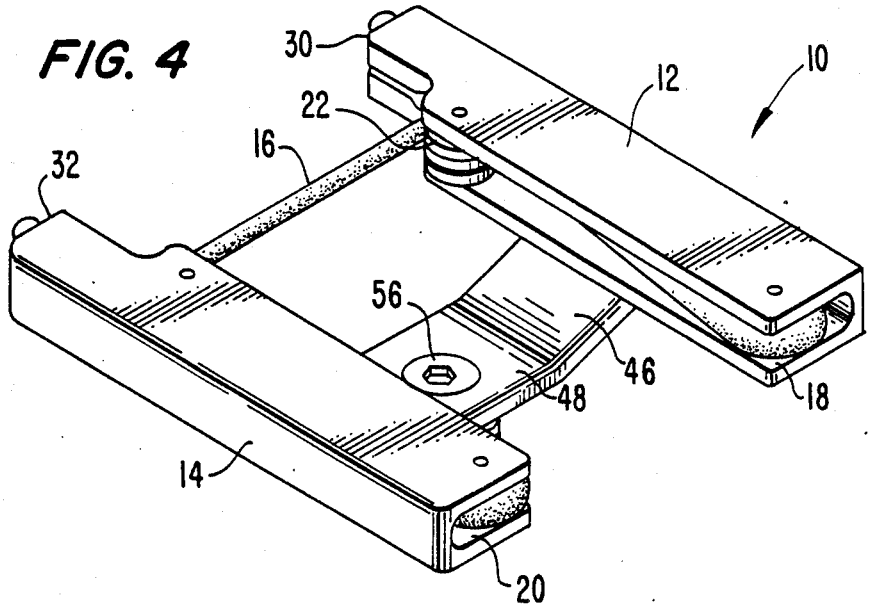
FIG. 4 is a perspective view of the device as shown in FIG. 1.
Figure 5:
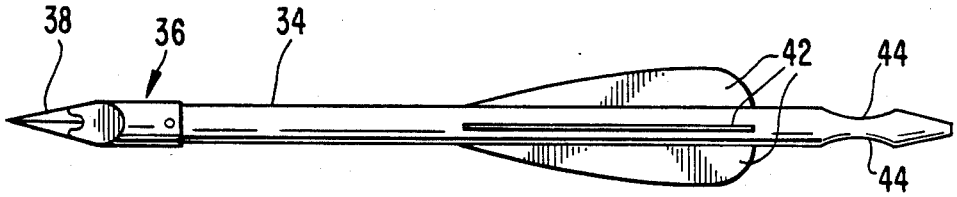
FIG. 5 is an elevation of the arrow.
Figure 6:
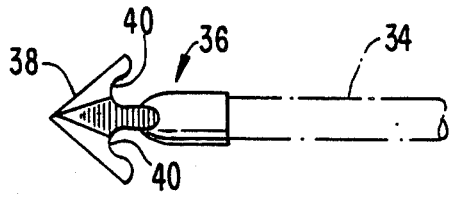
FIG. 6 is a top view of the arrowhead disconnected from the arrow as shown in FIG. 5.

As can be seen in FIG. 1, the apparatus for shooting an arrow, shooting accessory 10, includes two (2) spaced apart channel members, a first channel member 12 spaced in parallel relationship with second channel member 14 and fixed in these spaced relationships by a support structure 19. An elastic cord 16 is fixed within the channel members by a mechanism which permits the cord to be retracted into a firing position as shown in FIG. 1 for delivery of the projectile which, in this case, is an arrow 34.

Each channel member 12 and 14 includes its respective first and second channel, 18 and 20, which extends substantially the entire length of the channel member from front to rear. For the purposes of discussion, the front portion of the device will be that portion to the left of the viewer and the rear portion will be that portion to the right of the viewer. These descriptions have been adapted simply for convenience in describing various elements on the device.

Within these channels there are a series of pulleys about which the elastic cord 16 is sheaved to facilitate its movement between a normal position as shown and the firing position as shown in phantom lines of FIG. 1. A first pulley 22 is fixed for rotation in first channel 18 adjacent to the front end. Similarly, a second pulley 28 is fixed for rotation in the second channel 20 adjacent to front end of the apparatus. Near the rear end of the first channel 18, there is arranged for rotation a third pulley 24. Similarly, a fourth pulley 28 is arranged for rotation in second channel 20.

With this configuration, the cord 16 is sheaved about all pulleys 22, 24, 26 and 28 as shown. Specifically, one end of the cord 16 is fixed to the front end 30 of channel member 12, extends rearedly toward the third pulley 24, is sheaved about the third pulley 24, and extends forwardly to first pulley 22 about which it is sheaved as well. Cord 16 then extends across the path defined between the two channel members 12 and 14 and is sheaved about second pulley 28, extends rearwardly, is sheaved about the fourth pulley 26 after which the cord extends forwardly and is fixed to front end 32 of the second channel member 14.

As can be seen in the phantom line, this enables the elastic band to be drawn into a firing position without unnecessary friction and other impediments to the operation of the cord. In the normal position, the elastic cord is retracted to a relatively taut disposition extending between the pulleys 22 and 24 in opposed relationship as shown.

The projectile utilized in this device is a small arrow 34 about 8 inches in length having an arrowhead 36 about 2 inches in length. The arrowhead is specifically configured to enable attachment to the cord 16 during movement into the firing position and also disengage the cord once fired. For this purpose, it should be noted that the barb 38 defined by arrowhead 36 include grooves 40 on the rear surface thereof. These grooves are also referred to as hooks. The arrowhead is fixed to the front portion of the arrow 34 as shown and stabilizers 42 are affixed to the rear portion of the arrow in the usual fashion to maintain the arrow in the directed path of flight once it is fired.

At the rear most portion of the arrow behind the stabilizer 42, there is formed an indentation 44. This indentation 44 provides an area which can be grapsed by the fingers of the user for pulling the arrow to the firing position as can be seen in the phantom lines of FIG. 1.

For holding the channel members 12 and 14 in spaced relationship there is provided a support structure including a first leg 46 and a second leg 50 extending generally downwardly from the respective channel members 12 and 14. These leg members 46 and 50 are connected by a cross connector bar 48. The space defined between channel members, the leg members, and the cross bar is sufficient to permit passage of the arrow when fired.

An attachment means is provided for securing the mechanism described above to handle 62 of the knife 60. In this specific embodiment the attachment mechanism 52 includes a threaded rod 53 having an "O" ring 54 thereon for sealing interface of shooting accessory 10 and knife handle 62 when secured together. Knife 60 on the other hand, defines a threaded bore 66 for threaded engagement with the threaded rod 53. Once in place, the "O" ring will be pressed sufficiently against a portion of the handle to seal the handle against the threaded bore and prevent moisture from breaching the interface.

The threaded rod 53 can also be removed from the cross member 48. For this purpose, it should be noted that threaded rod 53 is secured to cross bar 48 through a hole 66 by an allen head screw 56 which screws into a complementary threaded portion 64 in the threaded bore.

This facilitates packing of the various elements of the accessory 10 in small quarters. It should also be noted that the configuration permits the accessory to be carried on the knife sheath if that is so desired as well. For this purpose the cord 16 can be wrapped about the knife handle to hold the accessory against the sheath when not in use.

In operation, the top of the knife is unscrewed to permit the accessory to be attached thereto. The accessory is then screwed in place into threaded bore 66 in top of the handle to fix it in relationship to the knife. To use the weapon, the arrowhead 34 is placed generally along the center of cord 16 between the two channel members 12 and 14 with the groove 40 engaging the elastic cord 16. The indented portion 44 is grasped by the user to pull the arrow 34 as engaged with the cord 16 into the firing position as shown in phantom lines. Once a target has been found, the arrowhead is released and the apparatus will then propel the projectile to the desired target.

It should be understood that the full scope of the invention is described in the claims which follow. These claims should be accorded a scope which encompasses those elements which logically fall within the language of the claims as well as any equivalents and modifications which are not explicitly in the claims but flow from the detailed description as discussed above and consistent with the contribution of the invention.

What is claimed:

1. An apparatus for shooting a projectile comprising:

a first channel member having a first distal end and a first proximate end, a second channel member having a second distal end and a second proximate end, said second channel member spaced from said first channel member and substantially parallel thereto, said channel members having respectively first and second longitudinal channels extending substantially the entire length of each channel member;

a rigid connector for fixedly connecting said channel members in spaced reltionship;

a first pulley fixed for rotation in said first channel support;

a second pulley fixed for rotation in second channel support;

a resilient cord supported between said first and second channel members and having a first portion fixed to said first channel member and sheaved about said first pulley and having another end fixed to said second channel member and having a portion sheaved about said second pulley, said first and second sheaves being arranged in opposite relationship to one another within said first and second channels, said first and second sheaves being located adjacent said distal end of its respective channel; said cord being sufficiently resilient to propel a projectile;

a knife having a knife handle, said channel members and rigid connector having means for releasably securing said rigid connector with said channel members fixed thereto to said knife handle, said rigid channel members being spaced sufficiently to permit said projectile to pass therebetween; and a third pulley fixed for rotation with respect to said first channel displaced from said first pulley and fourth pulley fixed for rotation with respect to said second channel at a position spaced from said second pulley, said cord being fixed at said distal end of said first channel, being sheaved about said first and third sheaves and extending toward said second pulley, said cord being sheaved about said second and fourth pulleys and extending to said distal end of said second channel and being fixed thereto, said cord being sheaved about said pulleys for permitting movement of said cord into an extended position for delivery of said projectile.

2. The apparatus according to claim 1 wherein said releasably securing means includes a first threaded portion for engaging a second complementary portion on said knife.

3. The apparatus according to claim 2 wherein said first threaded portion is releasably fixed to said connector.

4. The apparatus according to claim 3 wherein said connector includes a first leg connected to said first channel member, a second leg connected to said second channel member, a cross member connected to said first and second channel members, said cross member being spaced sufficiently from said channel members to provide a path for said projectile.

5. The apparatus according to claim 4 in combination with a projectile wherein said projectile includes a body portion, a head, and stabilizers for stabilizing the path and flight of said projectile.

6. The apparatus according to claim 5 wherein said head portion is in the shape of an arrowhead.

7. The apparatus according to claim 6 wherein a hooking means is provided for engaging said cord and maintaining engagement when said cord is pulled to a cocked position, said hooking means enabling a release from said cord when the cord retracts from a cocked position for propelling the projectile.

8. The apparatus according to claim 7 wherein said projectile includes an indented portion for grasping by the user to pull said projectile when engaged with said cord to a cocked position.

9. The apparatus according to claim 8 wherein said body portion is in the form of a shaft, said arrowhead has a tip and two barbs extending therefrom, said hooking means being formed by the configuration of said barbs having a hooking surface of sufficient radius of curvature to readily engage said cord when pulling said cord into a cocked position and for readily disengaging said cord when released.

10. The apparatus according to claim 9 wherein said releasably securing means removably secures said cross-member to said knife handle.

11. The apparatus according to claim 10 wherein said releasably securing means includes a means for sealing said handle member of said knife.

12. The apparatus according to claim 11 wherein said sealing means includes a "O" ring carried in a circumferential groove for engagement with a portion of said knife handle to prevent fluid from passing between the portion of the releasably securing means on said cross member and the complementary portion of said releasably securing means on said knife handle, said first threaded portion of said releasably securing means including a threaded rod secured to said cross member, and said second threaded portion including a threaded bore in said handle for threadedly engaging said threaded rod.

13. An apparatus for shooting a projectile comprising:

a first channel member having a first distal end and a second distal end and a second proximate end, said second channel member spaced from said first channel member and substantially parallel thereto, said channel members having respectively first and second longitudinal channels extending substantially the entire length of each channel member;

a projectile having a body portion in the form of a shaft, a head portion in the shape of an arrowhead having a tip and two barbs extending therefrom, an indented portion for grasping by the user to pull said projectile when engaged with said cord to a cocked position, and stabilizers for stabilizing the path and flight of said projectile;

a first pulley fixed for rotation in said first channel support;

a second pulley fixed for rotation in second channel support;

resilient cord supported between said first and second channel members and having a first portion fixed to said first channel member and sheaved about said first pulley and having another end fixed to said second channel member and having a portion sheaved about said second pulley, said first and second sheaves being arranged in opposite relationship to one another within said first and second channels, said first and second sheaves being located adjacent said distal end of its respective channel; said cord being sufficiently resilient to propel the projectile;

a third pulley fixed for rotation with respect to said first channel displaced from said first pulley and fourth pulley fixed for rotation with respect to said second channel at a position spaced from said second pulley, said cord being fixed at said distal end of said first channel, being sheaved about said first and third sheaves and extending toward said second pulley, said cord being sheaved about said second and fourth pulleys and extending to said distal end of said second channel and being fixed thereto, said cord being sheaved about said pulleys for permitting movement of said cord into an extended position for delivery of said projectile;

a rigid connector for fixedly connecting said channel members in spaced relationship, said connector includes a first leg connected to said first channel member, a second leg connected to said second channel member, a cross member connected to said first and second channel members, said cross member being spaced sufficiently from said channel members to provide a path for said projectile;

a knife having a knife handle with a second threaded portion; said first and second channel members and rigid connector having a first threaded portion releasably fixed to said cross member for removably securing said cross member to said second threaded portion on said knife handle, said first threaded portion of said cross member including a threaded rod secured to said cross member, and said second threaded portion including a threaded bore in said handle for threadedly engaging said threaded rod; and an "O" ring carried on a circumferential groove for engagement with a portion of said knife handle to prevent fluid from passing between the first threaded portion of said cross member and said second threaded portion of said attachment means on said knife handle; and a hooking means for engaging said cord and maintaining engagement when said cord is pulled to a cocked position, said hooking means enabling a release from said cord when the cord retracts from a cocked position for propelling the projectile, said hooking means being formed by the configuration of said barbs having a hooking surface of sufficient radius of curvature to readily engage said cord when pulling said cord into a cocked position and for readily disengaging said cord when released.

* * * * *